United States Patent [19]

Suzuki et al.

[11] 4,387,743

[45] Jun. 14, 1983

[54] APPARATUS FOR REGULATING TENSION IN WARPS OF A WEAVING MACHINE

[75] Inventors: Hajime Suzuki, Anjo; Yoshifumi Umemura, Toyoake; Masahiko Kimbara, Kariya, all of Japan

[73] Assignee: Kabushiki Kaisha Toyoda Jidoshokki Seisakusho, Aichi, Japan

[21] Appl. No.: 252,041

[22] Filed: Apr. 8, 1981

[30] Foreign Application Priority Data

Jun. 20, 1980 [JP] Japan ..... 55/84185

[51] Int. Cl.[3] ..... D03D 49/04; D03D 49/06

[52] U.S. Cl. ..... 139/110; 139/115; 66/211

[58] Field of Search ..... 139/110, 109, 103, 97, 139/114, 115; 66/211, 213; 242/75.5

[56] References Cited

U.S. PATENT DOCUMENTS

| | | | |
|---|---|---|---|
| 813,833 | 2/1906 | Ryder | 139/115 |
| 1,612,051 | 12/1926 | Quig | 139/109 |
| 3,255,784 | 6/1966 | Rothfuss et al. | 139/110 |
| 4,193,428 | 3/1980 | Demuth | 139/114 |

FOREIGN PATENT DOCUMENTS

| | | | |
|---|---|---|---|
| 25326 | 12/1883 | Fed. Rep. of Germany | 139/110 |
| 48-23108 | 7/1973 | Japan | 139/110 |

*Primary Examiner*—James Kee Chi

*Attorney, Agent, or Firm*—Burgess, Ryan and Wayne

[57] ABSTRACT

An apparatus for regulating tension in warps of a weaving machine comprising: a tension lever swingably supported on a weaving machine and having a roller supported thereon for regulating the tension in warps delivered from a warp beam; a weight lever swingably supported on the weaving machine and having a load at one end thereof; and a link operatively connecting the tension lever and the weight lever. The tension lever has an elongated hole formed thereon, and the lever ratio of the tension lever is changed by moving the link along the elongated hole.

The apparatus further includes a support member having two pairs of guide rollers and being connected to the link, so that the relative movement between the link and the tension lever can smoothly be carried out.

8 Claims, 11 Drawing Figures

APPARATUS FOR REGULATING TENSION IN WARPS OF A WEAVING MACHINE

FIELD TO WHICH THE PRESENT INVENTION RELATES

The present invention relates to an apparatus for regulating tension in warps of a weaving machine, such as a power loom, an air jet loom or a water jet loom, which is conventionally well known.

BACKGROUND OF THE INVENTION

In a weaving machine, warps delivered from a warp beam are fed to heddles through a plurality of rollers, such as a back roller and a tension roller. Conventionally an apparatus for regulating tension in warps is widely utilized for regulating the tension in the warps in accordance with, for example, the type of the woven fabric so that woven fabrics having a ground weave and hand which are in demand as manufactured fabrics can be manufactured. A so called weight lever type tension regulating apparatus has been commonly utilized. The apparatus comprises a tension lever for supporting a tension roller; and a loading means, such as a weight or a spring, connected to said tension lever in order to create a desired tension in warps by displacing said tension roller.

However, such a conventional apparatus has a disadvantage in that the adjusting of the loading means based on the kind of warps or the type of the woven fabrics is troublesome. Accordingly, the weaving operation is often unsatisfactory because of unsatisfactory adjustment of the loading means, such as a weight or a spring. More specifically, if the tension in warps created by the loading means is small, the response of the regulating apparatus becomes slow. Contrary to this, if the tension in warps created by the loading means large, the response of the regulating apparatus becomes excessively high and adversely affects the weaving operation.

SUMMARY OF THE INVENTION

An object of the present invention is to provide an apparatus for regulating tension in warps, by which the disadvantage involved in the adjustment of the loading means of the conventional apparatus can be eliminated.

Another object of the present invention is to provide an apparatus for regulating tension in warps, which is provided with a means for varying a lever ratio and by which the tension in warps can easily be adjusted in a wide range without changing the load of the loading means.

Still another object of the present invention is to provide an apparatus for regulating tension in warps, which is provided with a guide roller means and by which lever ratio varying operation can readily be carried out.

BRIEF DESCRIPTION OF THE ATTACHED DRAWINGS

Conventional apparatuses and an embodiment of the present invention will now be explained in detail with reference to the attached drawings, wherein.

DETAILED DESCRIPTION OF THE INVENTION

Figure 1:
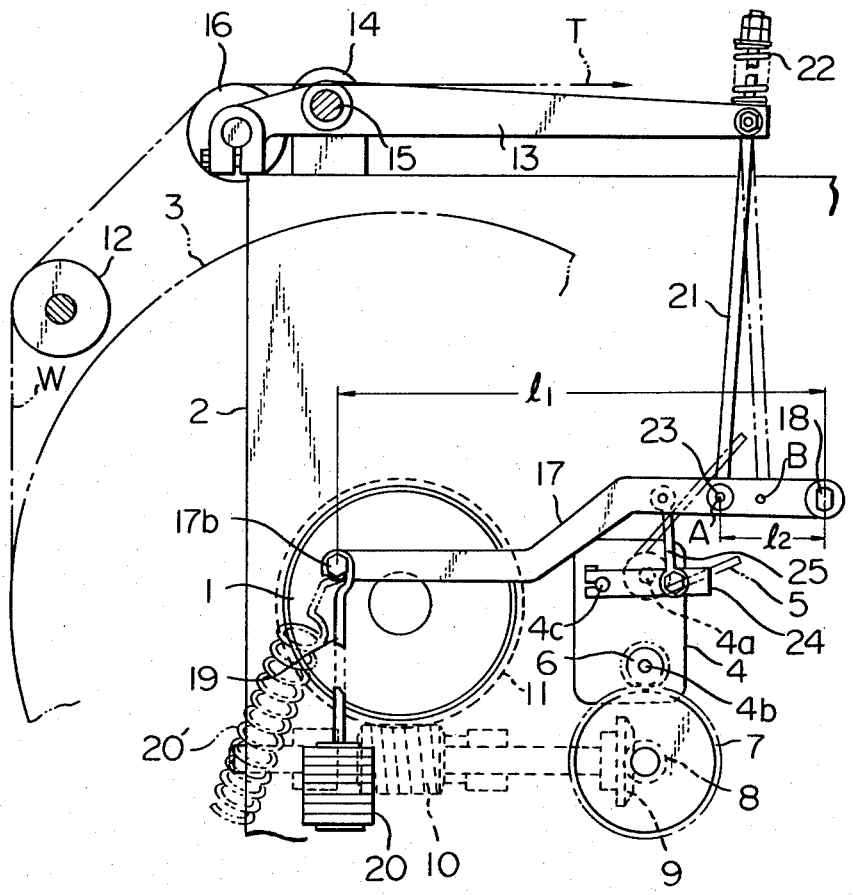
Fig. 1 PRIOR ART
FIG. 1 is a side view of a conventional apparatus for regulating tension in warps.

A conventional weight lever type apparatus for regulating tension in warps will now be explained first with reference to FIG. 1. In FIG. 1, 1 denotes a shaft of a warp beam which is rotatably supported on a machine frame 2 of a weaving machine and which detachably supports a warp beam 3 between the shaft 1 and the side of the machine frame 2 facing the shaft 1. Reference numeral 4 denotes a speed change device disposed on one side of the machine frame 2. The speed change device 4 has: an input shaft 4*a* driven by a conventional drive shaft (not shown) of the weaving machine, via a toothed belt 5; and an output shaft 4*b* transmitting the output power which is obtained by changing the speed by means of the speed change device 4. The output shaft 4*b* has a pinion 6 attached thereto which engages with a spur gear 7. A bevel gear 8 coaxial with the spur gear 7 engages with another bevel gear 9 which is coaxial with a worm 10 meshing with a worm wheel 11 attached to one end of the shaft 1 of the warp beam. Accordingly, the output power of the speed change device 4 is transmitted to the shaft 1 of the warp beam through the pinion 6, the spur gear 7, the bevel gears 8 and 9, the worm 10 and the worm wheel 11. As a result, the warp beam 3 is positively rotated in synchronization with the shedding operation of the weaving machine as the drive shaft rotates.

Reference numeral 12 denotes a back roller which is rotatably supported between the left ends of the machine frame 2 at a location above the warp beam 3 and which guides warps W delivered from the warp beam 3.

Reference numeral 13 denotes tension layers (only one of which is illustrated in FIG. 1) rotatably supported by means of a shaft 15 on a pair of support mounts 14 fixed on both sides of the machine frame 2. A roller 16 for regulating tension in warps is rotatably supported between the rear ends of the tension levers 13. As a result of the above-explained construction, warps W delivered inclinedly and upwardly from the warp beam 3 through the back roller 12 are fed to heddles (not shown) through the tension roller 16. The change in tensions in warps is detected by the tilting movement of the tension lever 13 caused by the vertical movement of the tension roller 16.

Reference numeral 17 denotes a weight lever swingably supported on the machine frame 2 by means of a shaft 18. The weight lever 17 has a pin 17*b* secured to the left end thereof which serves to hang down a hanging hook 19 with balance weights 20 or to connect a tension spring 20' which is illustrated by a dot and dash line in FIG. 1. A connecting rod 21 has: a compression spring 22 at the upper end thereof for connecting to the right end of the tension lever 13; and a connecting pin 23 at the lower end thereof for connecting to the portion adjacent to the right end of the weight lever 17. As a result of this construction, as the tilting movement of the tension lever 13 caused by the change in tension in warps, the weight lever 17 is also tilted by means of the connecting rod 21.

A speed change lever 24 connected to a speed change shaft 4c of the speed change device 24 is connected to the weight lever 17 by way of a synchronizing link 25, so that the reduction ratio of the speed change device 4 is varied in accordance with the tilting movement of the weight lever 17 caused by the change in tension in warps, and so that the rotational speed during unwinding operation of the warp beam 3 is controlled in order to maintain an adequate tension in warps regardless of the change in tension.

In the conventional apparatus for regulating tension in warps explained above, the tension T being exerted on the warps W is balanced with the weight 20 or the spring 20'. Accordingly, theoretically the adjustment of the tension T in warps upon, for example, the change of the type of woven fabric can be carried out by changing the total weight of the weight 20 or the spring force exerted by a spring 20'. However, in actual fact, if the tension T in warps is excessively small because of an excessively light weight, the response of the lever mechanism for actuating the tension roller 16, the mechanism comprising the tension lever 13 and the connecting rod 21, becomes slow. Accordingly, the speed change operation of the speed change device 4 cannot smoothly be done. As a result, there occurs a disadvantage in that the weaving operation is adversely affected.

Contrary to this, if the tension W in warps is excessively large due to the heavy weight 20, the response of the lever mechanism for actuating the tension roller 16 becomes too fast to stably effect the speed change operation of the speed change device 4. As a result, there occurs a similar disadvantage in that the weaving operation is also adversely affected.

To obviate the above-explained disadvantages, the above-explained conventional apparatus for regulating tension in warps has a specially designed construction by which the degree of the response of the lever mechanism is varied in accordance with change in tension T in warps W. More specifically, the location of the connecting pin 23 connecting the weight lever 17 and the connecting rod 21 is varied so that the ratio of the distance $l_1$ between the shaft 18 and the working point of the weight 20 to the distance $l_2$ between the shaft 18 and the connecting pin 23 (which ratio $l_1/l_2$ is referred to as a lever ratio of the weight lever 17) is varied that the degree of response is adjusted. When the tension T in warps W is small, the connecting pin 23 is located at a position A in FIG. 1, so that the lever ratio of the weight lever 17 is decreased, and the degree of the response is enhanced. When the tension T in warps W is large, the connecting pin 23 is moved to position B in FIG. 1, so that the lever ratio of the weight lever 17 is increased, and the degree of the response is decreased. As a result, the weaving operation is intended to be stably carried out regardless of the change in tension T in warps W.

Figure 2:
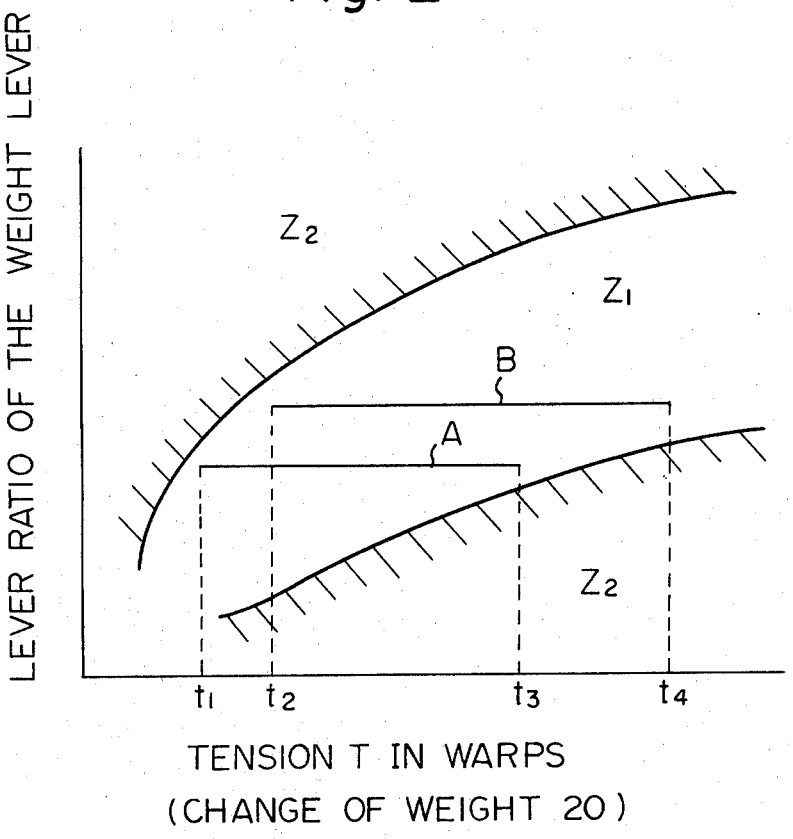
FIG. 2 is a diagram illustrating a warp tension controlling property of the apparatus illustrated in FIG. 1.

Incidentally, according to experimental tests concerning weaving operation, based on the tension T in warps W, i.e., the amount of the weight 20, and the lever ratio of the weight lever 17, the stably operative region $Z_1$ and the unstable and inoperative region $Z_2$ can be determined as illustrated in FIG. 2. In addition, the lines A and B in FIG. 2 also illustrate the maximum ranges of tension T in warps W, in which ranges the weaving operation can stably done, when the connecting pin 23 is located at positions A and B in FIG. 1. As is obvious from FIG. 2, in order to stably adjust the tension T in warps W in a wide range, it is desirable that the location of the connecting pin 23 is varied so that the lever ratio of the weight lever 17 is varied. However, in either case A or B in FIG. 2, the maximum range between $t_1$ and $t_2$, or $t_3$ and $t_4$ of the tension T in warps W is narrow. Furthermore, the adjustment of the weight 20 or the spring 20' (FIG. 1) is unavoidable and is troublesome.

U.S. application Ser. No. 252,042 filed Apr. 8, 1981 and assigned to the assignee of the present application, provides an apparatus for regulating tension in warps, which apparatus is provided with a means for varying a lever ratio and by which the tension in warps can easily be adjusted in a wide range without changing the weight or spring force.

The apparatus of the prior application will now be explained with reference to FIGS. 3 and 4.

An embodiment of the present invention will now be explained with reference to FIGS. 3 and 4.

Figure 3:
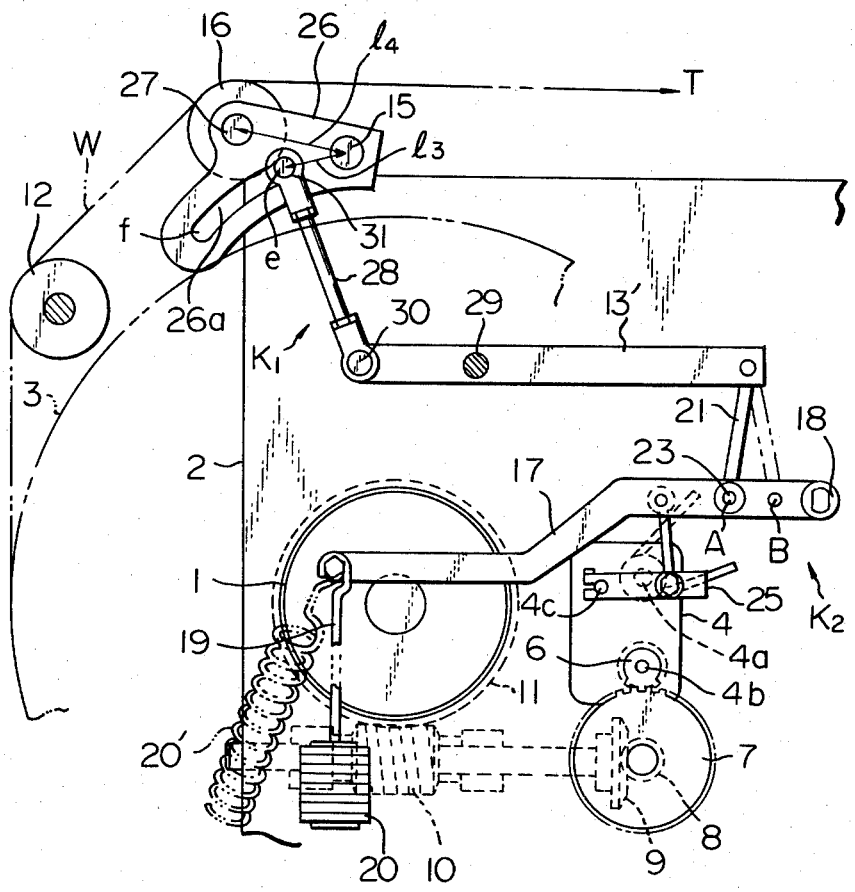
Fig. 3 PRIOR ART
FIG. 3 is a side view of another conventional apparatus for regulating tension in warps.
Figure 4:
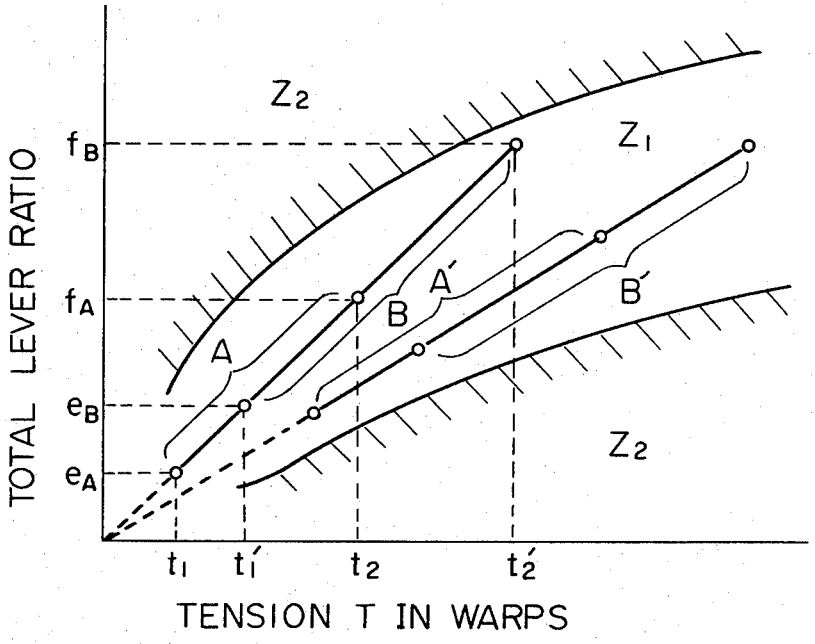
FIG. 4 is a diagram illustrating a warp tension controlling property of the apparatus illustrated in FIG. 3.

In FIG. 3, the parts which have constructions and functions similar to those of the conventional apparatus illustrated in FIG. 1 are denoted by the same reference numerals as those in FIG. 1, and their further explanation is omitted. Reference numeral 26 denotes a pair of tension levers, (only one of which is illustrated in FIG. 3) which have a tension roller 16 rotatably supported therebetween by means of a shaft 27. The tension levers 26 have circular arc-shaped elongated holes formed therein. An intermediate lever 13' is located beneath the tension lever 26 and is swingably supported by means of a shaft 29. The lower end of an adjusting link 28 is connected to the left end of the intermediate lever 13'. A connecting pin 31 is connected to the upper end of the adjusting link 28 and is pivotally connected to the elongated hole 26a in such a manner that the connecting pin 31 is movable along the elongated hole 26a. When the location of the connecting pin 31 is adjusted between the ends e and f of the elongated holes 26a, the ratio of the distance $l_3$ between the shaft 15 of the tension lever 26 and the connecting pin 31 to the distance $l_4$ between the shaft 15 and the shaft 27 of the tension roller 16 can be varied. The ratio $l_3/l_4$ is referred to as a lever ratio of the tension lever.

The apparatus for regulating tension in warps constructed in such a manner as explained above operates as follows. The solid lines in FIG. 3 illustrate a condition wherein the connecting pin 31 of the adjusting link 28 is located at one end of the elongated hole 26a near the shaft 15 so that the lever ratio of the tension lever 26 is minimum, and wherein the connecting pin 23 of the connecting rod 21 is located at position A far from the shaft 18 so that the lever ratio of the weight lever is also minimum. The lever ratio $e_A$ from the weight lever to the tension lever and the tension $t_1$ in warps W are illustrated in the lower left corner of FIG. 4. When the location of the connecting pin 31 is moved from position e to position f along the elongated hole 26a in FIG. 3 while the weight 20 or the spring 20' is maintained constant, the moment exerted on the tension lever 26 caused by the weight 20 through the weight lever 17 and the adjusting link 28 is increased due to the change of the lever ratio of the tension lever. As a result, the tension T in warps W is increased from $t_1$ to $t_2$ along line A as illustrated in FIG. 4 while the weight is unchanged.

When the connecting rod 23 illustrated in FIG. 3 is moved from position A to position B, the lever ratio of the weight lever is increased, and accordingly, the tension T in the warps W is increased. As the connecting pin 31 together with the adjusting link 28 is moved along the elongated hole 26*a* from one end e to the other end f, the total lever ratio is changed from $e_B$ to $f_B$ and the tension T in the warps W is increased from $t_1'$ to $t_2'$. Therefore, the tension can be adjusted in a wide range.

When enlargement of the tension adjusting region is required, while a heavier weight 20 is used and the connecting pin 23 is located at position A, the adjusting link 28 is moved along the elongated hole 26*a* from one end e to the other end f. As a result, the tension T in the warps W is varied as illustrated by A' while the heavier weight 20 is unchanged. When the adjusting link 28 is moved along the elongated hole 26*a* from one end e to the other end f after the connecting pin 23 is moved to position B, the tension T in the warps W is varied as illustrated by B' while the heavier weight 20 is unchanged.

As explained above, since in this apparatus, the adjusting link 28 which is capable of adjustment of the lever ratio of the tension lever 26 is disposed between the tension lever 26 and the intermediate lever 13', the tension T in warps can stably be adjusted in a wide range compared with the conventional apparatus for regulating tension in a warps while the weight 20 is unchanged. In addition, the tension in warps can easily be adjusted by a simple operation wherein the position of the adjusting link 28 is varied.

In the apparatus explained with reference to FIGS. 3 and 4, when the tension T in warps is changed while the weight 20 is maintained constant, the position where the elongated hole 26*a* formed in the tension lever 26 and the connecting pin 31 attached to the upper end of the adjusting link 28 are connected to each other must be changed so that the lever ratio of the tension lever 26 is changed. However, during the changing operation, since the inner side of the elongated hole 26*a* and the connecting pin 31 are exposed to a load exerted by the weight 20, the adjusting operation is often not easy because their relative location may easily be changed, and furthermore, the elongated hole 26*a* may be deformed or the connecting pin 31 may be bent.

In the present invention, a guide roller means is disposed at a space, where the link means is connected to the tension lever, so that the guide roller means serves to guide relative movement between the link means and the tension lever, and accordingly, the relative movement can smoothly be carried out.

Figure 5:
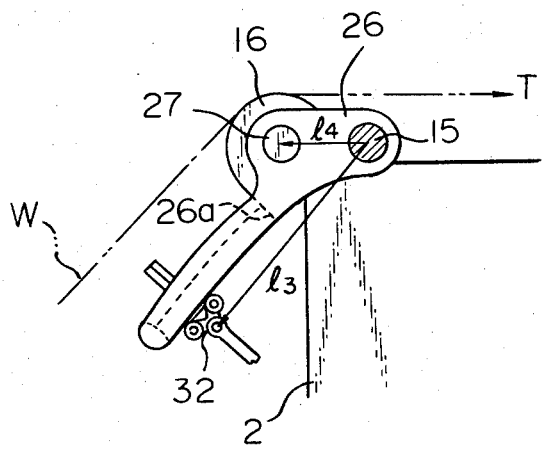
FIG. 5 is a partially enlarged side view of an embodiment of the present invention.

An embodiment will now be explained with reference to FIGS. 5 through 11. This embodiment has the same construction as that illustrated in FIG. 3 except for the connection between the tension lever 26 and the adjusting link 28, and accordingly, only the construction of this connection will be explained in detail. A pair of tension levers 26 (one of which is illustrated in FIG. 5) are swingably supported on a shaft 15 located at the upper portion of a machine frame 2 and support a tension roller 16 therebetween by means of a shaft 27. Each tension lever 26 has an elongated hole 26*a* formed therein and extending vertically.

Figure 6:
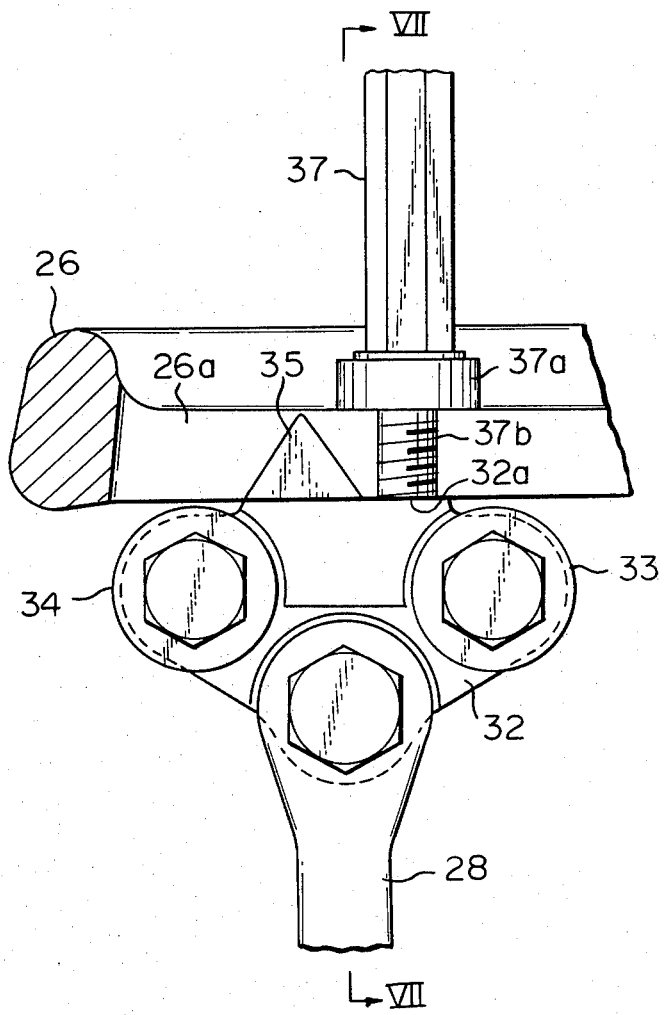
FIG. 6 is a partially enlarged cross sectional side view of FIG. 5.
Figure 7:
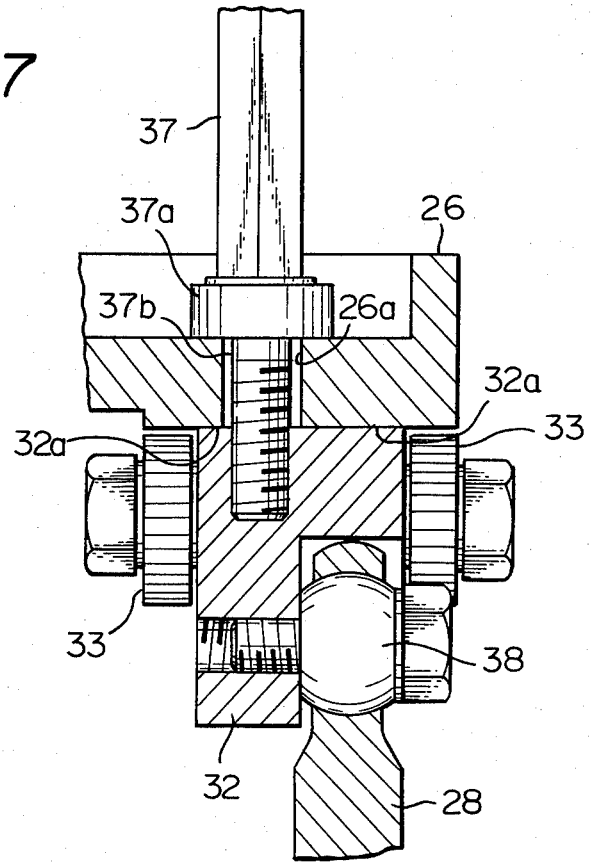
FIG. 7 is a cross sectional view taken along line VII—VII in FIG. 6.

Reference numeral 32 denotes a support member supported on the top of an adjusting link 28 via a universal joint 38 (FIG. 7). As illustrated in FIG. 6, the support member 32 has: an engaging surface 32*a* formed on the upper surface thereof and facing the lower side of the tension lever 26; and two pairs of rollers 33 and 34 rotatable along the lower surface of the tension lever in a direction of the elongated hole 26*a*, one pair is at the right and the other pair is at the left of the adjusting link in FIG. 6. Reference numeral 35 denotes an index formed in a triangular prism shape and inserted into the elongated hole 26*a* as illustrated in FIG. 8 so that it corresponds to the graduations 36 formed on the tension lever 26.

Figure 8:
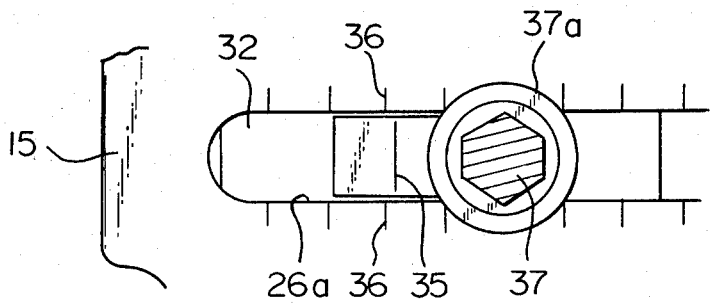
FIG. 8 is a partial plan view of FIG. 6.
Figure 9:
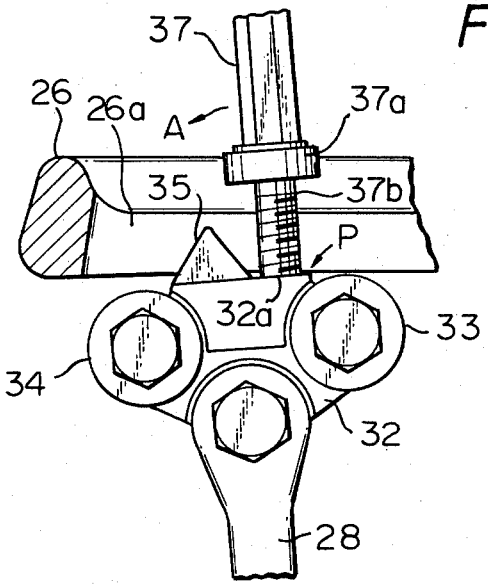
FIGS. 9 through 11 are partially enlarged cross sectional views which are utilized to explain the movement of a support member installed in the apparatus of FIG. 6.
Figure 10:
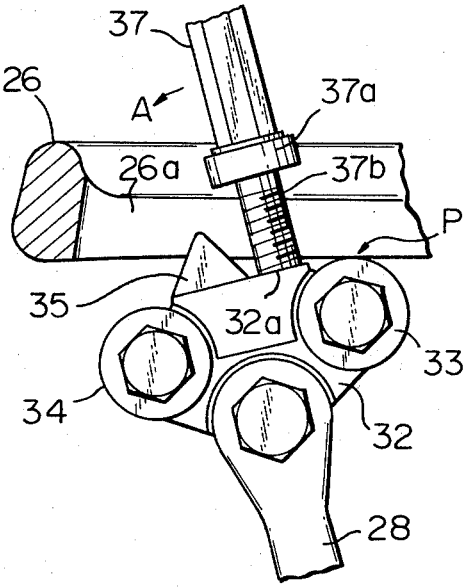

Reference numeral 37 illustrated in FIGS. 6 through 8 denotes a securing member formed in a hexagonal prism and having a bulged portion 37*a* and a male thread portion 37*b*. The securing member 37 also serves as a handle during the adjusting operation. The male thread portion 37*b* of the securing member 37 passes through the elongated hole 26*a* formed in the tension lever 26 and meshes with a female thread formed on the engaging surface 32*a*, so that the bulged portion 37*a* is in abutment with the upper surface of the tension lever 26, and so that the tension lever 26 is securely sandwiched between the bulged portion 37*a* and the support member 32.

The operation for securing the support member 32 at a desired position relative to the tension lever 26 will now be explained. As illustrated in FIGS. 6 and 7, while the engaging surface 32*a* of the support member 32 is in contact with the lower surface of the tension lever 26, the securing member 37 is tightened. After the bulged portion 37*a* of the securing member 37 abuts the upper surface of the tension lever 26, the support member 32 is lifted. Then, the engaging surface 32*a* of the support member 32 is urged to the lower surface of the tension lever 26, so that the location of the support member 32 is secured. Under this condition, the rollers 23 and 24 are slightly separated from the lower surface of the tension member. As a result, after the securing operation is completed, the adjusting link 28 is integrally connected to the tension lever 26 and is swingable about the universal joint 38, and the lever ratio $l_3/l_4$ of the tension lever 26 is set as illustrated in FIG. 5.

Operation for moving the support member 32 in order to vary the lever ratio will now be explained. The securing member 37 is loosened, and then, the securing member 37 is swung in a direction designated by the arrow A in FIG. 9. Accordingly, the support member 32 is swung around a fulcrum P which is the right end of the engaging surface 32*a* facing the lower surface of the tension lever 26. When the securing member 37 which now serves as a handle is further swung, the end of the engaging surface also separates from the lower surface of the tension lever 26, and the fulcrum P displaces onto one pair of rollers 33. The rollers 33 turn along the lower surface of the tension lever 26 so that the support member 32 is smoothly moved in a direction the same as that designated by the arrow A. Based on the indication between the index 35 and the graduations 36, the movement of the support member 32 is stopped at an appropriate position, and then, the securing member is tightened in a manner as explained above.

Figure 11:
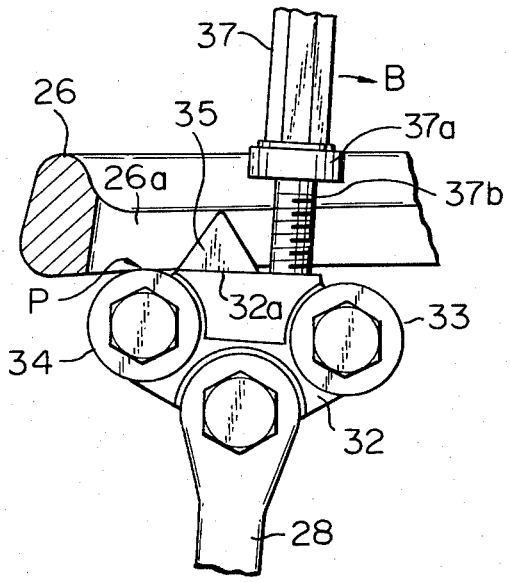

Contrary to this, if the support member is required to be moved in a reverse direction, the securing member 37 is swung in a direction designated by the arrow B (FIG. 11). Then the other rollers 24 serve as a fulcrum P, and the support member 21 moves in a direction the same as that designated by the arrow B.

Since the lever ratio varying operation explained above can be performed by only swinging the securing member 37 after it is loosened, the operation can be carried out while the weaving machine is operating.

The following embodiments which are not illustrated are also available.

(1) In spite of a universal joint 38, a support member 21 and an adjusting link 28 may be swingably connected to each other by way of another pivot member.

(2) If the support member 32 can be rigidly secured to a tension lever 26, it is unnecessary for rollers 33 and 34 to be separated from the tension lever 26 when the support member 32 is secured to a desired position.

We claim:

1. An apparatus for regulating tension in warps of a weaving machine comprising a tension lever swingably supported on said weaving machine and having a roller supported thereon for regulating the tension in warps delivered from a warp beam, a weight lever swingably supported on said weaving machine and having a load at one end thereof, and a link means operatively connecting said tension lever and said weight lever in such a manner that lever ratio in a system between said weight lever and said tension lever can be varied by displacing the connecting positions, characterized in that a guide roller means disposed at a place, where said link means is connected to said tension lever, and serving to guide relative movement between said link means and said tension lever while lever ratio varying operation takes places.

2. An apparatus according to claim 1, which further comprises an intermediate lever swingably supported on said weaving machine, one end of said intermediate lever being operatively connected to said tension lever by means of a first link, the other end of said intermediate lever being operatively connected to said weight lever by means of a second link, and said link means is composed of said first link.

3. An apparatus according to claim 2, which further comprises a support member supported at the front end of said link means and supporting said guide roller means for slidably engaging with said tension lever; and a securing member threaded with said support member through an elongated hole formed on said tension lever for securing said support member at a predetermined location relative to said tension lever.

4. An apparatus according to claim 3, wherein said support member is pivoted at said front end of said link means, and said guide roller means comprises at least two rollers which are opposite with respect to the pivot between said support member and said link means.

5. An apparatus according to claim 4, wherein, when said tension lever and said support member are secured to each other by means of said securing member, said support member has an engaging surface which is forcedly engaged with said tension lever, so that said rollers located at both sides of said engaging surface are separated from said tension lever.

6. An apparatus according to claim 3, wherein said securing member further serves as an operation handle for displacing said guide roller means together with said support member with respect to said tension lever.

7. An apparatus according to claim 1, wherein said load is a balance weight attached to said weight lever.

8. An apparatus according to claim 1, wherein said load is a spring connected to said weight lever.

* * * * *